United States Patent [19]

Jarrige et al.

[11] 4,303,119

[45] Dec. 1, 1981

[54] PROCESS FOR COOLING A METAL WIRE OBTAINED FROM A LIQUID JET

[75] Inventors: Guy Jarrige, Cournon d'Auvergne; Andre Reiniche, Clermont-Ferrand, both of France

[73] Assignee: Compagnie Generale des Etablissements Michelin, Clermont-Ferrand, France

[21] Appl. No.: 163,493

[22] Filed: Jun. 27, 1980

[30] Foreign Application Priority Data

Jul. 2, 1979 [FR] France ..... 79 17310

[51] Int. Cl.[3] ..... B22D 11/00

[52] U.S. Cl. ..... 164/462; 164/485

[58] Field of Search ..... 164/89, 122, 124, 128, 164/66, 67, 423; 264/28, 237

[56] References Cited

U.S. PATENT DOCUMENTS

| | | | |
|---|---|---|---|
| 3,658,979 | 4/1972 | Dunn et al. | 164/66 X |
| 3,861,452 | 1/1975 | Massoubre | 164/89 X |
| 4,149,584 | 4/1979 | Pflieger et al. | 164/423 X |

*Primary Examiner*—Robert D. Baldwin
*Assistant Examiner*—K. Y. Lin
*Attorney, Agent, or Firm*—Brumbaugh, Graves, Donohue & Raymond

[57] ABSTRACT

In order to cool the jet coming from a crucible and then the wire as it starts solidifying, there is used a gaseous cooling fluid mixture having a base of gaseous hydrogen and at least one other component which is a compound of hydrogen capable of an endothermic chemical reaction in contact with the jet (wire) and of a chemical composition such that the product or products of this reaction have a high molecular content (mol %) of free hydrogen.

8 Claims, No Drawings

PROCESS FOR COOLING A METAL WIRE OBTAINED FROM A LIQUID JET

This invention relates to processes for manufacturing a wire of metal or metal alloy in an installation comprising essentially a crucible containing the molten metal or metal alloy, a die arranged in a wall of the crucible, an enclosure containing a pressurizing fluid acting on the metal or metal alloy in the crucible and a cooling enclosure following the die and containing a gaseous cooling fluid mixture, the wire being obtained by projecting a jet of the metal or metal alloy, under the effect of the pressurizing fluid, through the die into the gaseous cooling fluid mixture contained in the cooling enclosure, wherein the liquid jet is cooled and transformed into solid wire.

U.S. Pat. No. 3,543,831 describes the cooling of a metal jet coming from a die by means of a suspension of liquid or solid particles. The particles are capable of reacting chemically in contact with the hot jet. The chemical reaction upon the contact of the particles with the jet may be of the endothermic type in the case of solid particles, they being intended to form a solid coating on the wire.

U.S. Pat. Nos. 4,149,584 and 4,153,099 describe an enclosure and a cooling fluid in which a fluid having a base of hydrogen and water vapor forming a mist is used. The droplets of water of the mist by coming into contact with the jet (wire) contribute by evaporation to the cooling of the latter.

The object of the present invention is to improve the rate of the heat exchange in the cooling enclosure between the jet (wire) and the gaseous cooling fluid mixture having a base of gaseous hydrogen and at least one other component.

The method of cooling employed in processes for the manufacture of wire of metal or metal alloy of the type described above, employing a gaseous cooling fluid mixture having a base of gaseous hydrogen and at least one other component contained in the cooling enclosure is characterized in accordance with the invention by the use of a gaseous cooling fluid mixture in which the other component is a compound of hydrogen capable of an endothermic chemical reaction in contact with the jet (wire) and of a chemical composition such that the product or products of this reaction have a high molecular content (mol %) of free hydrogen.

The invention thus constitutes a combination between the cooling effect due to the endothermic chemical reaction of the other component and the cooling effect due to the enrichment of the gaseous cooling fluid mixture in hydrogen by the large amounts of free hydrogen resulting from the reaction of the other component. Gaseous hydrogen has a thermal conductivity which is far greater than that of other gases, such as helium, argon, carbon dioxide and nitrogen. Furthermore, the specific heat per unit of mass of hydrogen is large.

The expression "jet (wire)" means that the gaseous cooling fluid mixture acts first of all on the jet but may also act on the wire, as long as the temperature of the wire permits the maintaining of the endothermic chemical reaction.

It is also possible to use as the other component an oxygen donor, particularly within the scope of the processes for the manufacture of steel wires in accordance with U.S. Pat. Nos. 3,933,441 and 3,861,452, the steel projected into the gaseous cooling fluid mixture having a content of silicon and possibly of manganese such that the oxidation product upon the contact of the jet with the gaseous cooling fluid mixture is silica. The silica sheathing thus produced stabilizes the jet and permits the manufacture of continuous wires.

Instead of using a single other component in the gaseous cooling fluid mixture containing hydrogen which dissociates within the course of an endothermic chemical reaction liberating free hydrogen when it comes into contact with the jet (wire), one may use two other components which react endothermically with each other in contact with the jet (wire), liberating free hydrogen.

Examples of gaseous cooling fluid mixtures which can be used within the scope of the process claimed are given below:

EXAMPLE 1

In this example, the other component of the gaseous cooling fluid mixture in accordance with the invention undergoes an endothermic chemical dissociation reaction when, in contact with the jet, it reaches its dissociation temperature. The component itself as well as the products resulting from its dissociation are chemically inert with respect to the jet (wire) of metal or metal alloy. A gaseous cooling fluid mixture of 50 mol % ammonia ($NH_3$) and 50 mol % hydrogen ($H_2$) is used. The liquid ammonia under pressure in a cylinder is autovaporized by expansion in a number of atomizers which discharge into the cooling enclosure. The boiling point of ammonia at a pressure of one atmosphere is equal to −33.3° C.

The ammonia coming into contact with a jet of liquid steel of a diameter of 1 mm dissociates endothermically in accordance with the equation:

$$2NH_3 \rightarrow N_2 + 3H_2$$

the products of the dissociation containing 75 mol % of free hydrogen.

The endothermic dissociation and the free hydrogen contributed by the dissociation absorb large amounts of heat.

The thermal transfer is increased by about 30% as compared with a gaseous cooling fluid mixture of water vapor and hydrogen.

EXAMPLE 2

In this example, there are two other components in the gaseous cooling fluid mixture in accordance with the invention which undergo an endothermic chemical reaction between themselves when, in contact with the jet, the temperature for this reaction is reached.

A first other component is water vapor, incorporated in $H_2$ by saturating the latter by passage through an ordinary humidifier which makes it possible to reach saturation with water at 70° C.; this gaseous mixture contains 69 mol % of hydrogen and is injected into the cooling enclosure. The second other component is propane (boiling point at one atmosphere; −42.6° C.) injected into the cooling enclosure. 50 mol % of the first other component (water vapor) are mixed with 50 mol % of the second other component (propane), the liquefied propane under pressure in a cylinder being autovaporized by expansion in a number of atomizers discharging into the cooling enclosure.

The propane ($C_3H_8$) coming into contact with the jet (wire) of stainless steel of 1.75 mm in diameter participates, as well as the water vapor, in the endothermic chemical reaction in accordance with the equation.

$$C_3H_8+3H_2O \rightarrow 3CO+7H_2$$

the products of the reaction containing 70 mol % free hydrogen.

The thermal transfer is improved by about 50% as compared with a gaseous cooling fluid mixture of water vapor and hydrogen.

It is to be noted that the carbon monoxide (CO) liberated during the said reaction contains oxygen. It can therefore be used as oxygen donor of the gaseous cooling fluid mixture for the production of silicon steel wire by the processes described in U.S. Pat. Nos. 3,861,452 and 3,933,441 which have been mentioned above.

In place of propane, one can use other hydrocarbons which have a boiling point less than ambient temperature, are of low cost and are readily available on the market in liquid and compressed state, such as ethane, butane, isobutane, propadiene and butadiene.

EXAMPLE 3

A gaseous cooling fluid mixture containing 45 mol % of hydrogen ($H_2$) and 55 mol % of the following two other components is used:

1st other component: 45 mol % of propane ($C_3H_8$) injected at several points close to the jet (wire) after expansion in an orifice with auto-vaporization of the propane coming from a liquefied gas cylinder under pressure.

2nd other components: 10 mol % of water vapor ($H_2O$) injected at several points close to the jet (wire) after expansion in an orifice with auto-vaporization of the water heated to 200° C. under a pressure of 17 atmospheres.

After endothermic chemical reaction between the water vapor (steam) and propane in contact with the jet (wire) in accordance with the equation $$C_3H_8+3H_2O \rightarrow 3CO+7H_2,$$

the products of the reaction contain 70 mol % of free hydrogen.

The heat transfer is improved 53% as compared with a gaseous cooling fluid mixture of water vapor and hydrogen.

In these three examples, the gaseous cooling fluid mixture in accordance with the invention has a specific weight greater than that of a gaseous cooling fluid mixture of hydrogen and water vapor: The gaseous cooling fluid mixture of Example 1 has a specific weight which is 4.75 times greater, the gaseous cooling fluid mixture of Example 2 has a specific weight which is 11.5 times greater, and the gaseous cooling fluid mixture of Example 3 has a specific weight which is 10.4 times greater than that of a gaseous cooling fluid mixture of hydrogen and water vapor. To use a gaseous cooling fluid mixture of a specific weight greater than that of a gaseous cooling fluid mixture of hydrogen and water vapor is of interest, particularly in installations in which a gasous cooling fluid mixture is also used to support the jet (wire) and/or stabilize it.

In general, the gaseous cooling fluid mixture in accordance with the invention is at a pressure close to ambient pressure.

Furthermore, it is advantageous to use a gaseous cooling fluid mixture having a base of as large an amount as possible of hydrogen, preferably at least 30 mol % not exceeding 80 mol % of the initial composition of the gaseous cooling fluid mixture, as well as one or more other components, the product or products of the endothermic chemical reaction of which in contact with the jet (wire) contain as large an amount as possible of free hydrogen, preferably at least 50 mol %. By "initial composition" there is understood the composition of the gaseous cooling fluid mixture before the contact with the jet (wire) and before the endothermic chemical reaction which this contact initiates. By "reaction products" there are understood the products appearing on the right-hand side of the chemical equations symbolizing the endothermic chemical reaction.

What is claimed is:

1. A process for cooling a wire of metal or metal alloy produced in an installation comprising essentially a crucible containing the molten metal or metal alloy, a die arranged in a wall of the crucible, an enclosure containing a pressurizing fluid acting on the metal or metal alloy in the crucible and a cooling enclosure following the die and containing a gaseous cooling fluid mixture having a base of gaseous hydrogen and at least one other component, the wire being obtained by projecting a jet of the metal or metal alloy through the die into the gaseous cooling fluid mixture contained in the cooling enclosure, characterized by the use of a gaseous cooling fluid mixture in which said other component is a compound of hydrogen capable of an endothermic chemical reaction in contact with the jet (wire) and of a chemical composition such that the product or products of said reaction have a high molecular content (mol %) of free hydrogen.

2. The process according to claim 1, characterized by the use of a gaseous cooling fluid mixture having a base of at least 30 mol % not exceeding 80 mol % of gaseous hydrogen referred to the initial composition of the gaseous cooling fluid mixture.

3. The process according to claim 1 or claim 2, characterized by the fact that said other component has a chemical composition such that the product or products of said reaction contain at least 50 mol % of free hydrogen.

4. The process according to claim 1, characterized by the fact that the gaseous cooling fluid mixture contains two other components which participate in an endothermic chemical reaction in contact with the jet (wire).

5. The process according to claim 1, characterized by the fact that said other component undergoes an endothermic chemical dissociation reaction in contact with the jet (wire).

6. The process according to claim 1 used to manufacture wire by projecting a jet of steel into a gaseous cooling fluid mixture, the steel having a content of silicon and possibly of manganese such that the oxidation product upon the contact of the jet with the gaseous cooling fluid mixture is silica, characterized by the fact that a product of the endothermic chemical reaction in contact with the jet (wire) contains oxygen and is used as an oxygen-donor of the gaseous cooling fluid mixture.

7. The process according to claim 1, characterized by the fact that said other component is ammonia.

8. The process according to claim 1, characterized by the fact that said other components are water vapor and a hydrocarbon selected from the group consisting of ethane, propane, butane, isobutane, propadiene and butadiene.

* * * * *